US005318489A

United States Patent [19]

Irwin

[11] Patent Number: 5,318,489

[45] Date of Patent: * Jun. 7, 1994

[54] ADJUSTABLE STEPPING STRUCTURE FOR AEROBIC EXERCISES

[75] Inventor: Lyle R. Irwin, Kennesaw, Ga.

[73] Assignee: The Step Company, Atlanta, Ga.

[ * ] Notice: The portion of the term of this patent subsequent to Oct. 27, 2009 has been disclaimed.

[21] Appl. No.: 849,286

[22] Filed: Mar. 10, 1992

Related U.S. Application Data

[63] Continuation of Ser. No. 763,864, Sep. 20, 1991, Pat. No. 5,158,512.

[51] Int. Cl.[5] ..... A63B 22/04; A63B 26/00

[52] U.S. Cl. ..... 482/52; 482/142

[58] Field of Search ..... 482/52, 53, 148, 142; 108/91, 53.3, 901, 144

[56] References Cited

U.S. PATENT DOCUMENTS

| | | | |
|---|---|---|---|
| 3,630,157 | 12/1971 | Ortenblad | 108/901 |
| 4,203,525 | 5/1980 | Okubu | 482/52 |
| 4,678,234 | 7/1987 | Wilson | 297/439 |
| 4,826,158 | 5/1989 | Fields . | |
| 5,158,512 | 10/1992 | Irwin et al. | 482/52 |

FOREIGN PATENT DOCUMENTS

| | | | |
|---|---|---|---|
| 0901614 | 5/1972 | Canada | 482/52 |
| 0195671 | 9/1986 | European Pat. Off. . | |
| 2711104 | 11/1979 | Fed. Rep. of Germany . | |
| 3128122C2 | 4/1985 | Fed. Rep. of Germany . | |
| 3136451C2 | 6/1985 | Fed. Rep. of Germany . | |

OTHER PUBLICATIONS

Photograph and Description of Vaulting Box.

*Primary Examiner*—Stephen R. Crow
*Attorney, Agent, or Firm*—William H. Needle

[57] ABSTRACT

An adjustable stepping structure for aerobic exercises comprising a platform upon which the participant places his or her feet, the platform being elevated above a support surface by means of one or more support elements which are capable of being detachably stacked upon each other until the platform is maintained at a selected distance above the support surface, depending upon the skill and physical characteristics of the participant.

25 Claims, 4 Drawing Sheets

FIG 1
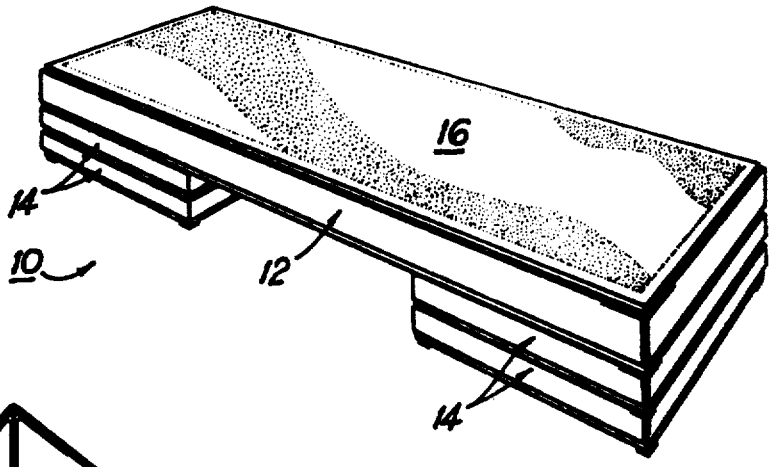
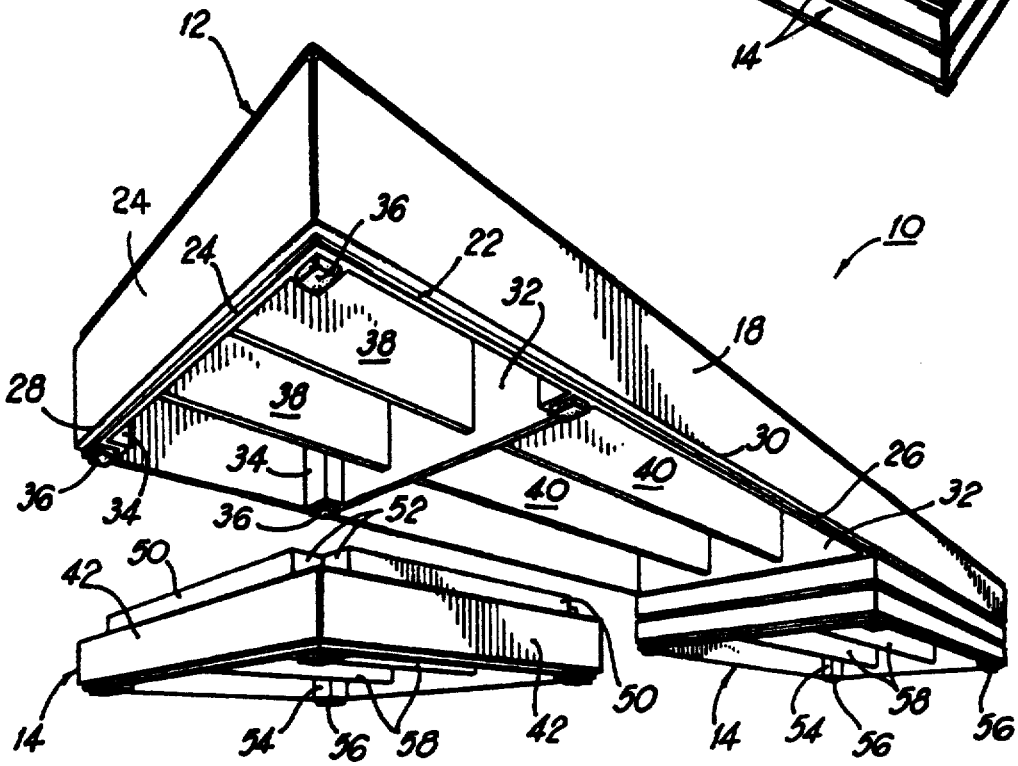
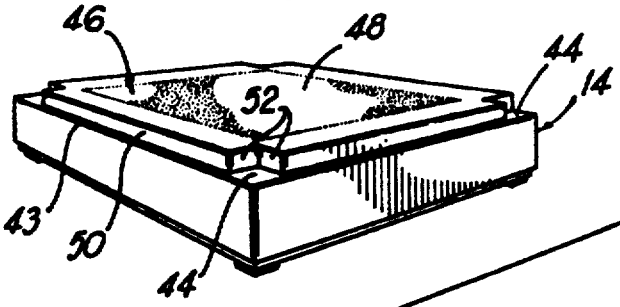
FIG 2
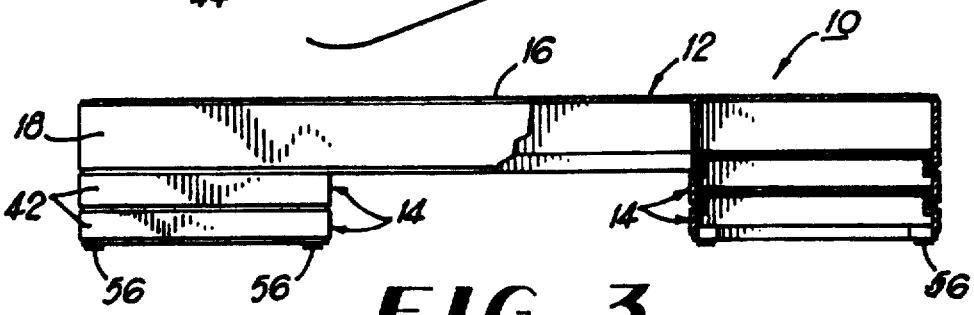
FIG 3

ADJUSTABLE STEPPING STRUCTURE FOR AEROBIC EXERCISES

This application is a continuation of application Ser. No. 07/763,864, filed Sep. 20, 1991, now U.S. Pat. No. 5,158,512.

BACKGROUND OF THE INVENTION

The present invention relates to aerobic exercise devices and, more particularly, to an adjustable stepping structure for aerobic exercises.

It is known in aerobic exercising to use a conditioning program based on stair climbing to develop, simultaneously, strength and improved cardiovascular endurance. For instance, during a 60-minute aerobic workout, the participant may, using optional hand-held weights, climb on and off platforms that are available at a number of different heights. Such stepping sessions may last for from five to twenty-five minutes per period during such workouts and are combined with traditional aerobic movements.

The disadvantage of the present stair climbing programs is that they utilize fixed-height platforms which do not easily accommodate participants of varying degrees of physical height or expertise in aerobics. Also, the fixed platforms or steps make it more difficult to vary the intensity of the exercise. In group classes, the participant may be forced to use a step at a particular height based only upon availability and not upon proper sizing. This can make a workout either too hard or too easy. Also, in the home market, the fixed-height platform does not allow for interval training or improved conditioning of the participant.

SUMMARY OF THE INVENTION

The above disadvantages of the existing exercise stepping systems are overcome by the present invention which provides a unitary, aerobic exercise structure that has a platform upon which the participant steps and which is adjustable in elevation above a support surface. Specifically, two structures are described, each structure including a rectangular platform section that has a flat top surface and a plurality of equally dimensioned support elements which are stackable, one upon the other, each of the elements capable of being detachably engageable with the underside of the platform section so that it is elevated a selected distance above the floor, depending upon the skill and physical characteristics of the user.

The present invention incorporates into one space-saving structure the necessary features of the individual stepping structures of varying heights.

BRIEF DESCRIPTION OF THE FIGURES OF THE DRAWINGS

FIG. 1 is a perspective view of the first embodiment of the present invention;

FIG. 2 is an exploded, perspective view of the structure of the first embodiment of the present invention;

FIG. 3 is a front view of the first embodiment of the present invention with a portion broken away for clarity.

DETAILED DESCRIPTION OF THE ILLUSTRATIVE EMBODIMENT

A. First Embodiment

Figure 4:
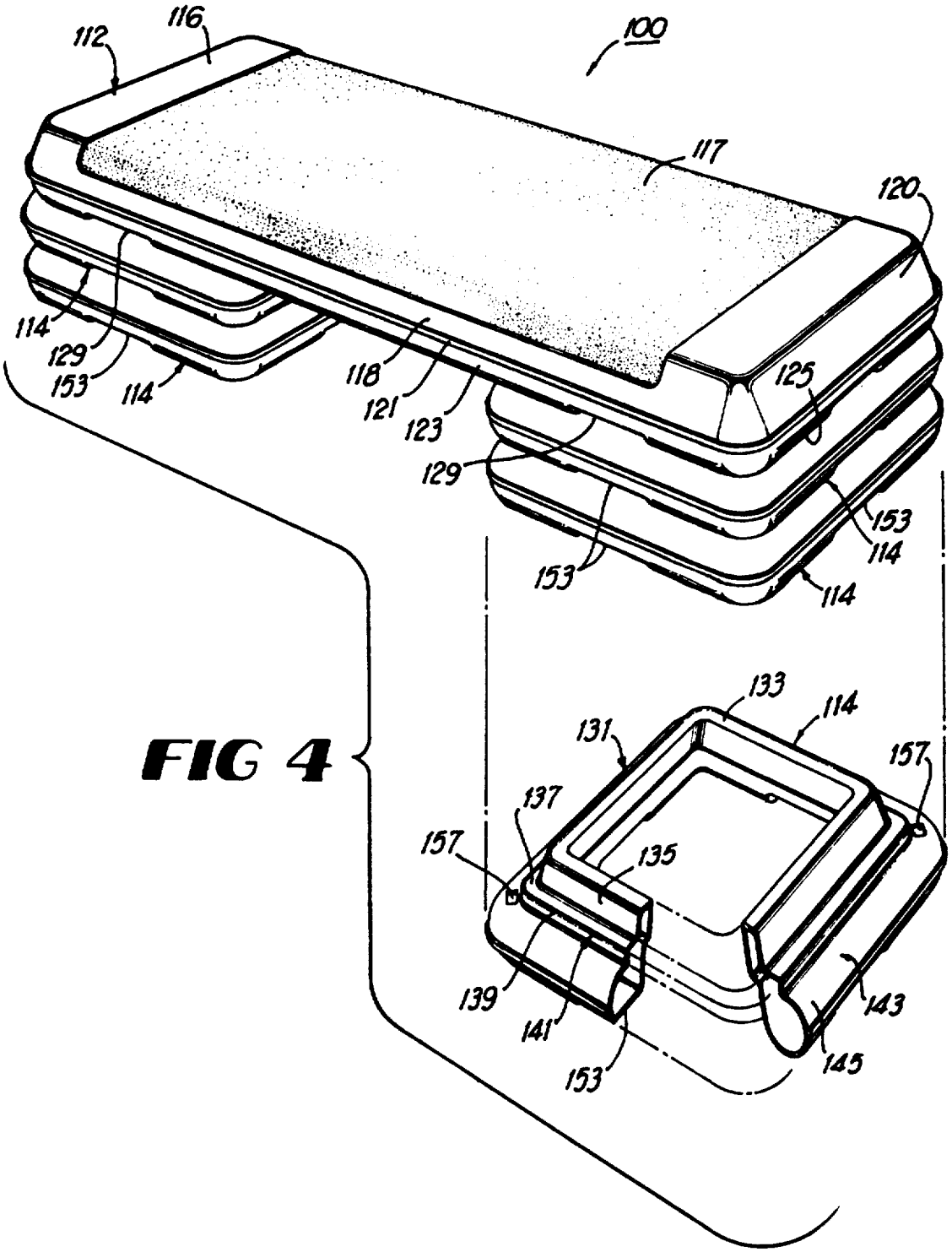
FIG. 4 is an exploded perspective view of the second embodiment of the present invention.
Figure 5:
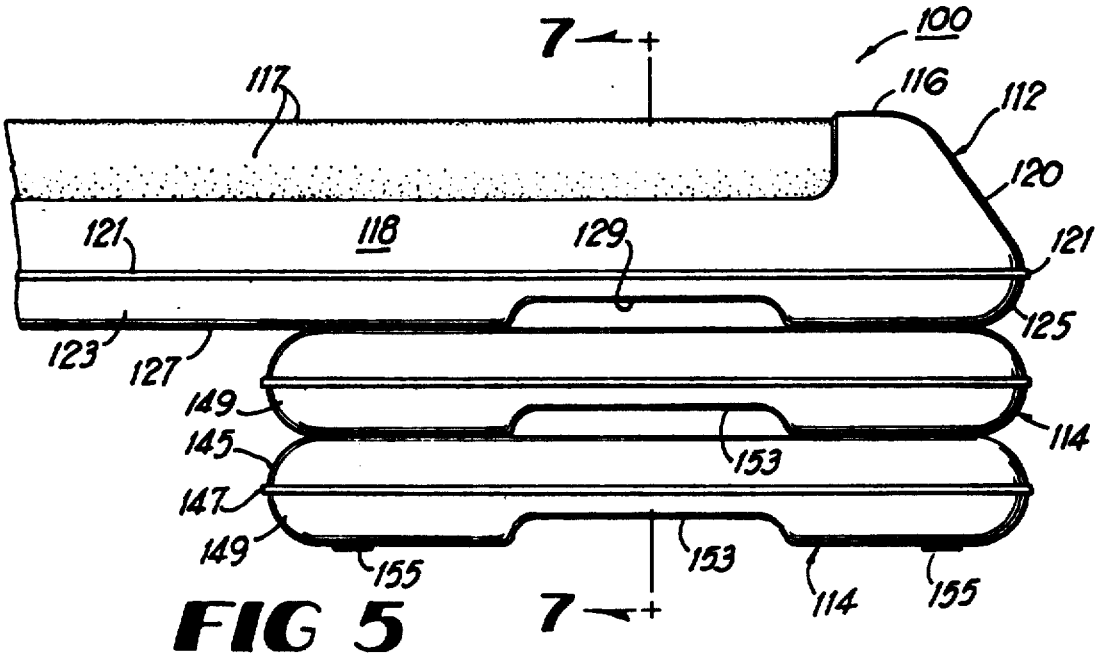
FIG. 5 is a front view of a portion of the second embodiment of the present invention.

Referring to the FIGS. 1-3 of the drawings, the numeral 10 denotes generally the first embodiment of the adjustable stepping structure which comprises a platform section 12 and a plurality of means for elevating the platform section 12 a predetermined distance above a support surface, namely, support elements 14. The section 12 is rectangular in shape and includes a top, stepping surface 16 with depending, parallel side walls 18 and opposed, parallel end walls 20. The surface 16 preferably has a non-slip coating thereon.

Means are provided on the bottom of the section 12 to allow the detachable securing of one of the support elements 14 thereto. Basically, such means comprise at least one opening in underside of section 12 into which is received a portion of the top of one of the support elements 14 as seen in FIGS. 2 and 3. A rectangular frame 22 is provided on the bottom surface of side walls 18 and end walls 20. The frame 22 is comprised of end members 24 which underlie end walls 20 and side members 26 which run along the bottom of side walls 18. The members 24, 26 are offset from the outer respective edges 28, 30 of end walls 20 and side walls 18 so as to be complementary to and engage the top surface of the support elements 14, as described below.

Laterally extending between side walls 18 are ribs 32, the distance between the respective side wall 18 and rib 32 being equal to the width of the support elements 14. Elongated, rectangular column members 34 are formed at the intersections of rib 32 and side walls 18 and end walls 20 and side walls 18. Rectangular pads 36 are disposed on the bottoms of the column members 34 and extend below the frame 22. As seen in FIG. 2, a pair of struts 38 longitudinally extend between end walls 20 and the respective ribs 32, with struts 40 longitudinally extending between the ribs 32. The struts 38, 40 provide a means of strengthening the section 12.

The support elements 14 are squares and are of equal dimensions to each other, comprising sides 42 and top 44. An upper element 46 overlies top 44 except at the respective corners and adjacent the upper edges 43 of the sides 42, where top 44 is exposed. The upper element 46 includes an upper surface 48 and depending sides 50, each of which is offset from edges 43 and terminates adjacent their ends in inwardly directed edges 52. The space defined by converging edges 52 is dimensioned to receive therein the columns 34 and pads 36 of the platform section 12. When the columns 34 are received within the above-described spaces on support elements 14, the bottom surface of the ribs 38 engage the upper surface 48 and end members 24 and side members 26 engage the top 44 exposed between upper edges 43 and sides 50.

The under surface of each support element 14 is complementary to both the upper element of the other support elements 14 (so that they may be stacked upon each other), and the underside of the platform section 12 (so that each support element 14 is capable of detachably engaging and supporting the platform section 12 above the floor). Each support element 14 includes column members 54 with pads 56 on their bottom surfaces and a pair of strengthening ribs 58. The support elements 14 are stackable upon each other in the same manner as each is capable of engaging the platform section 12, namely, the columns 34 are received within the space formed by edges 52 and top 44 and the upper surface 48 engages the bottom surfaces of ribs 58.

The dimensions of a typical platform section 12 are either 48"×14"×4" or 36"×14"×4" and the dimensions of a typical support element 14 are 14"×14"×2". The stepping surface 16 can be elevated off the ground from 6 inches to 12 inches, in 2-inch increments, by adding the required number of support elements 14. Also, the interlocking, stackable support elements 14 provide stability as the height is increased.

B. Second Embodiment

FIGS. 4–7 depict the second embodiment of the present invention, denoted generally by the numeral 100, and comprising a platform section 112 and a plurality of support elements 114 which provide means for vertically adjusting the height of platform section 112 above a support surface, such as a floor. The second embodiment 100 is constructed of a molded high impact plastic materials and functions or operates in the same manner as the first embodiment 10. The basic difference between the two is their respective outward appearance, the second embodiment 100 having a more "modern" look than the first.

Figure 7:
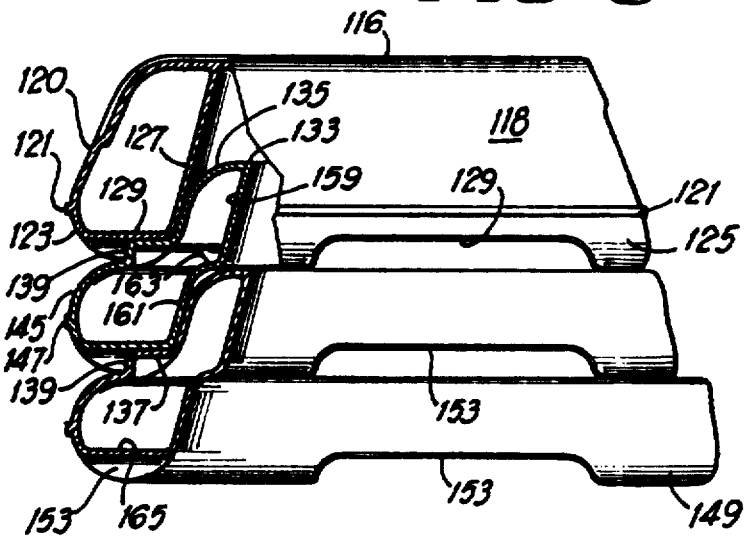
FIG. 7 is a view of the second embodiment of the present invention taken along line 7—7 in FIG. 5.

The platform section 112 is generally triangular in shape with a top, stepping surface 116 having a non-slip, textured coating 117 thereon. The side and end walls 118, 120 slant outwardly from the top surface 116 and terminate in horizontally extending, continuous rib 121. The walls 118, 120 then curve downwardly in sections 123, 125 which terminate in flat bottom 127. As seen more clearly in FIG. 5, hand-holds 129 are provided through section 123 to aid in maneuvering the platform section 112. As seen in FIG. 7, the platform section 112 includes an interior wall 127 laterally extending between side walls 118 adjacent each end wall 120 and which projects downwardly from the underside of top surface 116 in sloping direction which parallels approximately the slope of end wall 120. The wall 127 terminates in a horizontal base 129 that is directed toward end wall 120.

Each support element 114 is capable of being telescopingly received within the bottom of the platform section 112, as well as being so received within the bottom of another support element 114 so that they are vertically stackable, as shown in FIG. 4. The support element 114 is a square shaped unitary member and is open through its center. Each element comprises three sections with the top section 131 having a slightly rounded top 133 and a downwardly curved shoulder 135 which terminates in horizontal ledge 137 with wall 139 depending therefrom. The ledge 137 and wall 139 form the middle section 141. The lower section 143 includes a bulbous portion 145 that terminates in rib 147. Inwardly curved bottom portion 149 extends beneath rib 147 and concludes with a flat bottom 151. Hand-inserts 153 are formed in the center of each bottom portion 149 to provide a location for gripping when the support elements 114 are moved about.

Figure 6:
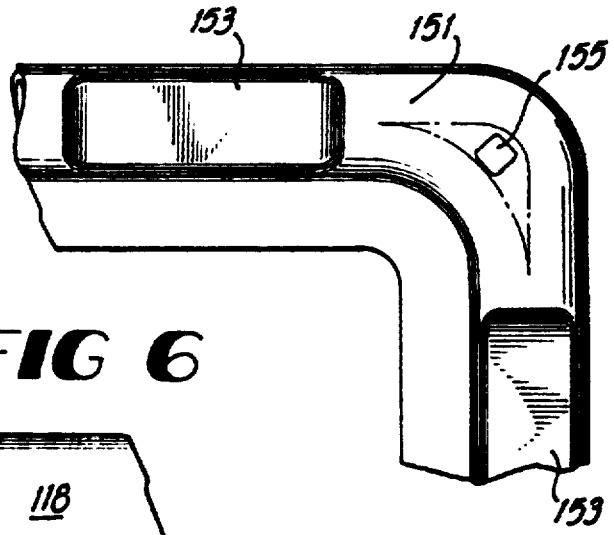
FIG. 6 is a bottom plan view of a portion of one of the support elements of the support elements of the second embodiment of the present invention.

As seen in FIG. 6, a square-shaped lug 155 is located at each corner on bottom 151 and are in registry with similarly shaped depressions 157 located on portion 145, as seen in FIG. 4. When the support elements 114 are placed upon each other, the lugs 155 on an upper element 114 are received within a respective lower element 114 to aid in stabilizing the stacked elements 114.

As seen most clearly in FIG. 7, each element 114 includes interior walls 159, 161 joined by curved section 163 with the slope of walls 159, 161 being the same as that of interior wall 127 of the platform section 112. The bottom edge of wall 161 terminates in horizontally extending base 165.

When a support element 114 is telescopingly received within the bottom of platform section 112, the shoulder 135 contacts interior wall 127 and ledge 137 engages the underside of base 129. When an additional support element 114 is added, it is received within an upper support element 114 by having shoulder 135 rest against the underside of curved portion 163 and wall 161, with base 165 resting on ledge 137.

The above-described support elements 14, 114 and the structural means employed to allow them to be stackable in vertical alignment and to support the platform section 12, 120 are merely an example of the currently operable ones. However, any number of other designs could be used such as, for example, having upstanding ribs or plugs on the top of the support elements 14, 114 which are complementary in shape and engage slots on the underside of both the platform section and each support element 14, 114.

Figure 8:
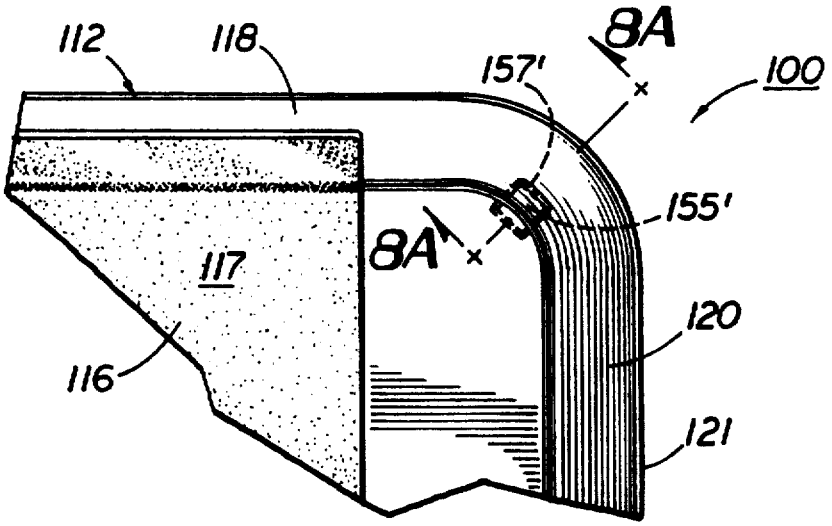
FIG. 8 is a top plan view of the corner portion of the second embodiment of the present invention.
Figure 8A:
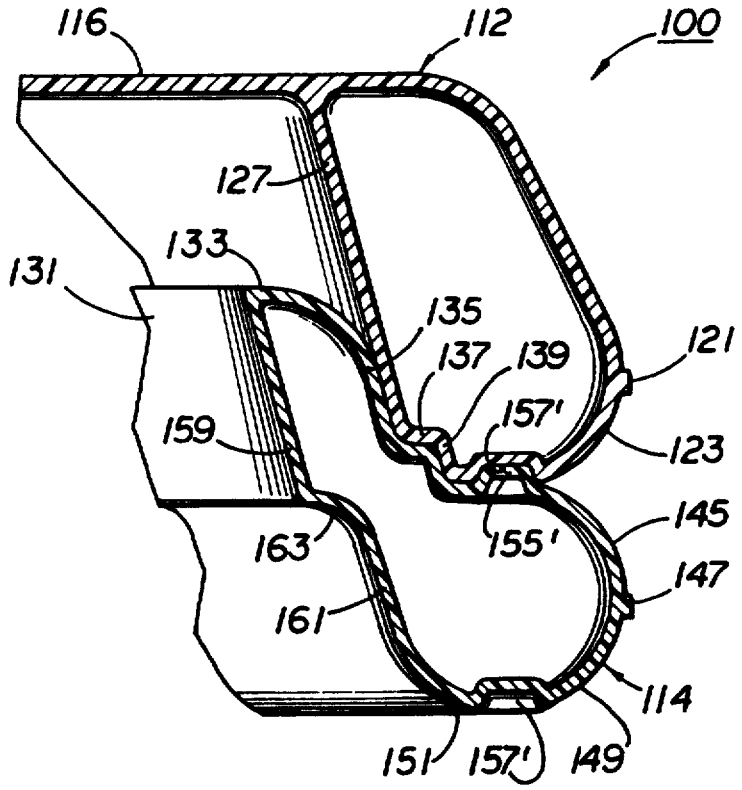
FIG. 8A is sectional view taken along line 8A—8A in FIG. 8.

FIGS. 8 and 8A illustrate such a design wherein protrusions 155' are located on portion 145 and are in registry with similarly shaped depressions 157' located at each corner on bottom 151.

A guide for choosing the proper height of the stepping surface 16 is as follows:

| HEIGHT OF SURFACE 16 | HEIGHT OF PARTICIPANT |
|---|---|
| 6" | Under 5' tall, a novice to aerobic exercise or pregnant |
| 8" | 5' to 5'6" |
| 10" | 5'6"–6'0" |
| 12" | 6'1" and above |

The major advantage of both embodiments of the present invention is its adjustability which allows the safe matching of a person's height and level of fitness with the correct height of stepping surface 16, 116. By being able to vary the step height, the participant can vary the intensity of the exercise to meet their individual needs. The structures 10, 100 can be adjusted during an exercise session by either adding or removing support elements 14, 114. This helps to maintain the intensity at the correct level within the target heart range.

The structures 10, 100 are used to elevate the heart rate of the participant. By using various elements in conjunction with an instructor or video cassette, the participant achieves a high intensity, low impact workout within their target heart range.

What I claim is:

1. An adjustable stepping structure for aerobic exercises comprising:

(a) a platform section having a substantially flat and continuous top stepping surface for receiving thereon the feet of the participant, a shaped underside surface opposite said stepping surface and an outer wall interconnecting said top stepping surface and said underside surface; and (b) means for elevating said top stepping surface of said platform section a selected distance above, and in a plane parallel to, a support surface, said elevating means comprising a support element having a bottom exterior, an opposite top exterior and a side wall interconnecting said bottom and top exteriors, one of said exteriors being shaped and the other of said exteriors being complementary in shape to and matingly engageable with both said underside surface of said platform section as well as said bottom exterior of said support element, whereby said participant may adjust said distance by utilizing with said platform section a selected one or more of said support elements, the vertical plane of said side wall extending no further than the vertical plane of said outer wall.

2. An adjustable stepping structure for aerobic exercises comprising:

(a) a platform section having a top substantially flat and continuous stepping surface for receiving thereon the feet of the participant, a shaped underside surface opposite said stepping surface and an outer wall interconnecting said top stepping surface and said underside surface;

(b) means for elevating said top stepping surface of said platform section a selected distance above, and in a plane parallel to, a support surface, said elevating means comprising a support element having a bottom exterior, an opposite top exterior and a side wall interconnecting said bottom and top exteriors, one of said exteriors being shaped and the other of said exteriors being complementary in shape to and matingly engageable along a portion of the edge thereof within both said underside surface of said platform section as well as said bottom exterior of said support element, whereby said participant may adjust said distance by utilizing with said platform a selected one or more of said support elements; and (c) a protrusion on said underside surface of said platform section and on said bottom exterior of said support element and a depression on the top exterior of said support element, said protrusion and depression being complementary in shape to, and matingly engageable and in registry with, each other to provide lateral stabilization of said platform section and said support element, the vertical plane of said side wall extending no further than the vertical plane of said outer wall.

3. An adjustable stepping structure for aerobic exercises, comprising:

(a) a platform section having a substantially flat and continuous top surface for receiving thereon the feet of the participant, at least one shaped engaging surface opposite said stepping surface and an outer wall interconnecting said top surface and said engaging surface;

(b) means for elevating said top surface of said platform section a selected distance above, and in a plane parallel to, a support surface, said elevating means comprising a support element having a first engaging surface an opposite second engaging surface and a side wall interconnecting said first and second engaging surfaces, said second engaging surface being shaped and said first engaging surface being complementary in shape to and matingly engageable with both shaped engaging surface of said platform section as well as said second engaging surface of another support element; and (c) a first stabilizing means positioned on an edge portion of said second engaging surface and an edge portion of said shaped engaging surface of said platform, and a second stabilizing means being complementary in shape to, and matingly engageable and in registry with, said first stabilizing means and being positioned on an edge portion of said first engaging surface, whereby the lateral position of said platform section relative to said support element is stabilized, the vertical plane of said side wall extending no further than the vertical plane of said outer wall.

4. An adjustable stepping structure for aerobic exercises comprising:

(a) a platform section having a top stepping surface for receiving thereon the feet of the participant and a shaped underside surface opposite said stepping surface;

(b) means for elevating said top stepping surface of said platform section a selected distance above, and in a plane parallel to, a support surface, said elevating means comprising a pair of support elements, each support element having a bottom exterior and an opposite top exterior, said top exterior being shaped and matingly engageable within said underside surface of said platform section, whereby said participant may adjust said distance by utilizing with said platform section said support elements; and (c) at least one depression on said underside surface of said platform section and at least one protrusion on the top exterior of each of said support elements, said protrusion and depression being complementary in shape to, and matingly engageable and in registry with, each other to provide lateral stabilization of said platform section and said support elements.

5. An adjustable stepping structure for aerobic exercises comprising:

(a) a platform section having a substantially flat top stepping surface for receiving thereon the feet of the participant and an underside surface opposite said stepping surface;

(b) means for elevating said top stepping surface of said platform section a selected distance above, and in a plane parallel to, a support surface, said elevating means comprising at least two separate horizontally aligned support elements disposed substantially underneath, and matingly engageable with, said platform section, each of said support elements having a shaped top surface;

(c) means for matingly engaging with said top surfaces of said support elements being incorporated within said underside surface of said platform section, said engaging means comprising an opening in said underside surface which receives therein an edge portion of said top surfaces of said support elements; and (d) a first stabilizing means on said underside surface of said platform section and a second stabilizing means on said top surfaces of said support elements, said first and second stabilizing means being complementary in shape to, and matingly engageable and in registry with, each other to provide lateral stabilization of said platform section and said support elements.

6. An adjustable stepping structure in accordance with claim 5 wherein said platform section is contoured about its periphery.

7. An adjustable stepping structure in accordance with claim 5 wherein said top stepping surface includes means for preventing slippage of the feet of the participant.

8. An adjustable stepping structure for aerobic exercises, comprising:

(a) a platform section having a substantially flat top stepping surface for receiving thereon the feet of the participant and at least one shaped engaging surface opposite said stepping surface;

(b) means for elevating said top stepping surface of said platform section a selected distance above, and in a plane parallel to, a support surface, said elevating means comprising at least two separate horizontally aligned support elements, each of said support elements having a first engaging surface being complementary in shape to and matingly engageable with said shaped engaging surface of said platform section; and (c) a first stabilizing means on said underside surface of said platform section and a second stabilizing means on said top surfaces of said support elements and being complementary in shape to, and matingly engageable and in registry with, said first stabilizing means, whereby the lateral position of said support elements and said platform section, relative to each other, is stabilized.

9. An adjustable stepping structure in accordance with claim 8 wherein said first and said second stabilizing means are positioned on a selected one of an edge portion of said shaped engaging surface of said platform and an edge portion of said first engaging surface.

10. An adjustable stepping structure in accordance with claim 8 wherein said platform section is contoured about its periphery and wherein said top stepping surface includes means for preventing slippage of the feet of the participant.

11. An adjustable stepping structure as claimed in claim 10 wherein said first and second stabilizing means comprise a depression and a protrusion for mating engagement with said depression.

12. An adjustable stepping structure as claimed in claim 11 wherein said first stabilizing means is said depression and said second stabilizing means is said protrusion.

13. An adjustable stepping structure for aerobic exercises comprising:

(a) a platform section having a substantially flat top stepping surface for receiving thereon the feet of the participant and an underside surface opposite said stepping surface;

(b) means for elevating said top stepping surface of said platform section a selected distance above, and in a plane parallel to, a support surface, said elevating means comprising a support element disposed substantially underneath, and matingly engageable with, said platform section;

(c) means for matingly engaging with said top surface of said support element being incorporated within said underside of said platform section, said engaging means comprising an opening in said underside of said platform section which receives therein an edge portion of said top surface of said support element; and (d) a first stabilizing means on said underside surface of said platform section and a second stabilizing means on said top surface of said support element, said first and second stabilizing means being complementary in shape to, and matingly engageable and in registry with, each other to provide lateral stabilization of said platform section and said support element.

14. An adjustable stepping structure in accordance with claim 19 wherein said top stepping surface includes means for preventing slippage of the feet of the participant.

15. An adjustable stepping structure in accordance with claim 19 wherein said platform section is contoured about its periphery.

16. An adjustable stepping structure for aerobic exercises comprising:

(a) a platform section having a substantially flat and continuous top stepping surface for receiving thereon the feet of the participant and a shaped underside surface opposite said stepping surface;

(b) means for elevating said top stepping surface of said platform section a selected distance above, and in a plane parallel to, a support surface, said elevating means comprising a support element having a bottom exterior and an opposite top exterior, said top exterior being shaped to and matingly engageable along a portion of the edge thereof within said underside surface of said platform section, whereby said participant may adjust said distance by utilizing said support element with said platform section; and (c) a protrusion on said underside surface of said platform section and on said bottom exterior of said support element and a depression on the top exterior of said support element, said protrusion and depression being complementary in shape to, and matingly engageable and in registry with, each other to provide lateral stabilization of said platform section and said support element.

17. An adjustable stepping structure in accordance with claim 16 wherein said elevating means comprises a pair of support elements.

18. An adjustable stepping structure in accordance with claim 16 wherein said platform section is contoured about its periphery and wherein said top stepping surface includes means for preventing slippage of the feet of the participant.

19. An adjustable stepping structure for aerobic exercises, comprising:

(a) a platform section having a substantially flat and continuous top stepping surface for receiving thereon the feet of the participant and at least one shaped engaging surface opposite said stepping surface;

(b) means for elevating said top stepping surface of said platform section a selected distance above, and in a plane parallel to, a support surface, said elevating means comprising a support element, having an engaging surface that is complementary in shape to, and matingly engageable with, said shaped engaging surface of said platform section; and (c) a first stabilizing means positioned on said shaped engaging surface of said platform and a second stabilizing means on said engaging surface on said support element that is complementary in shape to, and matingly engageable and in registry with, said first stabilizing means, whereby the lateral position of said support element and said platform section, relative to each other, is stabilized.

20. An adjusting stepping structure in accordance with claim 19 wherein said elevating means comprises at least two support elements.

21. An adjusting stepping structure in accordance with claim 19 wherein said first stabilizing means is positioned on an edge portion of said engaging surface of said platform and wherein said second stabilizing means is positioned on an edge portion of said first engaging surface.

22. An adjusting stepping structure in accordance with claim 19 wherein said platform section is contoured about its periphery and wherein said top stepping surface includes means for preventing slippage of the feet of the participant.

23. An adjustable stepping structure as claimed in claim 19 wherein said first and second stabilizing means comprise a depression and a protrusion for mating engagement with said depression.

24. An adjustable stepping structure as claimed in claim 23 wherein said first stabilizing means is said depression and said second stabilizing means is said protrusion.

25. An adjustable stepping structure for aerobic exercises comprising:

(a) a platform section having a substantially flat top stepping surface for receiving thereon the feet of the participant and an underside surface opposite said stepping surface;

(b) means for elevating said top stepping surface of said platform section a selected distance above, and in a plane parallel to, a support surface, said elevating means comprising a pair of support elements disposed substantially underneath, and matingly engageable with, said platform section;

(c) means for matingly engaging with said top surface of said support elements being incorporated within said underside of said platform section, said engaging means comprising an opening in said underside of said platform section which receives therein an edge portion of said top surface of said support elements; and (d) a first stabilizing means on said underside surface of said platform section and a second stabilizing means on said top surface of said support elements, said first and second stabilizing means being complementary in shape to, and matingly engageable and in registry with, each other to provide lateral stabilization of said platform section and said support elements.

* * * * *